US011560261B2

(12) United States Patent
Wang

(10) Patent No.: US 11,560,261 B2
(45) Date of Patent: Jan. 24, 2023

(54) DOUBLE-SPOUT BOTTLE COVER AND WATER BOTTLE

(71) Applicant: Shen Zhen Xin Yue Tang Plastic & Hardware Co., Ltd, Shenzhen (CN)

(72) Inventor: Chunlei Wang, Nanyang (CN)

(73) Assignee: Shen Zhen Xin Yue Tang Plastic & Hardware Co., Ltd, Shenzhen (CN)

( * ) Notice: Subject to any disclaimer, the term of this patent is extended or adjusted under 35 U.S.C. 154(b) by 18 days.

(21) Appl. No.: 16/893,448

(22) Filed: Jun. 5, 2020

(65) Prior Publication Data

US 2021/0086960 A1 Mar. 25, 2021

(30) Foreign Application Priority Data

Sep. 20, 2019 (CN) ..... 201910894202.8

(51) Int. Cl.
*B65D 47/08* (2006.01)
*B65D 25/46* (2006.01)
*B65D 47/06* (2006.01)

(52) U.S. Cl.
CPC ..... *B65D 47/08* (2013.01); *B65D 25/46* (2013.01); *B65D 47/061* (2013.01)

(58) Field of Classification Search
CPC .... B65D 2251/0021; B65D 2251/0081; B65D 2543/00046; B65D 2543/00231; B65D 25/46; B65D 47/08; B65D 47/061; A47G 19/2272; A47G 19/2266
USPC ..... 220/254.2, 254.3, 254.1, 254.5; 215/235, 215/229, 388; 222/482
See application file for complete search history.

(56) References Cited

U.S. PATENT DOCUMENTS 2,557,048 A * 6/1951 Haase ..... A45C 13/007 16/295
5,244,113 A * 9/1993 Stymiest ..... B65D 51/242 215/228
6,161,777 A * 12/2000 Carter ..... A45F 3/16 239/222.11
6,860,387 B2 * 3/2005 Chang ..... B65D 43/26 206/214
7,021,483 B2 * 4/2006 Tack ..... B65D 53/02 220/254.1
7,059,490 B2 * 6/2006 Son ..... B65D 47/065 220/254.3
7,416,093 B2 * 8/2008 Lin ..... A61B 50/37 220/254.5
7,931,166 B2 * 4/2011 Cuocolo, Jr. ..... B65D 47/0895 220/254.2

(Continued)

*Primary Examiner* — Charles P. Cheyney
(74) *Attorney, Agent, or Firm* — Bayramoglu Law Offices LLC

(57) ABSTRACT

A double-spout bottle cover includes a cover body. A second water outlet is arranged at the upper end of the cover body. A flip cover is covered on the second water outlet. The cover head of the flip cover covers the second water outlet. A flip cover shaft of the flip cover is fixed on the cover body and is opposite to the second water outlet. The middle of the flip cover is a hollow area. The hollow area is provided with a first water outlet, and the surface of the first water outlet is flush with the surface of the flip cover. The bottom of the first water outlet is connected to a preset through hole on the cover body. The first water outlet is fixed on the cover body by a rotating shaft.

20 Claims, 6 Drawing Sheets

(56) References Cited

U.S. PATENT DOCUMENTS

| | | | | |
|---|---|---|---|---|
| 7,971,317 | B2 * | 7/2011 | Guo | H05K 5/0226 16/297 |
| 8,672,174 | B1 * | 3/2014 | McMullin | A47G 21/18 220/703 |
| 9,392,893 | B2 * | 7/2016 | Sorensen | A47J 43/27 |
| 10,159,368 | B2 * | 12/2018 | Lin | B65D 47/065 |
| 10,512,347 | B1 * | 12/2019 | Shepard | B65D 47/148 |
| 2003/0052126 | A1 * | 3/2003 | Zettle | B65D 43/0212 220/254.3 |
| 2007/0205176 | A1 * | 9/2007 | Karp | A45D 40/222 215/237 |
| 2015/0282654 | A1 * | 10/2015 | Kurabe | B65D 43/163 220/254.5 |
| 2017/0297785 | A1 * | 10/2017 | Maruyama | B65D 41/04 |
| 2020/0255194 | A1 * | 8/2020 | Li | B65D 43/0218 |

* cited by examiner

DOUBLE-SPOUT BOTTLE COVER AND WATER BOTTLE

CROSS REFERENCE TO THE RELATED APPLICATIONS

This application is based upon and claims priority to Chinese Patent Application No. 201910894202.8, filed on Sep. 20, 2019, the entire contents of which are incorporated herein by reference.

TECHNICAL FIELD

The present disclosure relates to water bottles and bottle covers, and more particularly, to a double-spout bottle cover and a water bottle.

BACKGROUND

Lifestyles are increasingly diversifying due to the continuous improvement of living standards. Water consumption and bottle design each have become specialized to meet different activity demands. Different functional water bottles are used for outdoor sports, business trips, and daily use as needed. For example, during exercise, an ordinary water bottle is only provided with a spout in a specific size and thus cannot meet the demand for the water consumption in different periods of the exercise. Moreover, in most cases, water intake cannot be adjusted since the flow out of the container is determined by the size of the opening, which itself is typically non-adjustable. Prior water bottles are, therefore, limited in their utility to a single function and cannot meet changes in fluid flow demand.

SUMMARY

In order to overcome the shortcomings of the prior art, the present disclosure provides a double-spout bottle cover, including a first water outlet, which provides two water intake modes, and which is convenient to use and solves the problem of the non-adjustability of water outflow of conventional water bottles.

A double-spout bottle cover includes a cover body. A second water outlet is arranged at the upper end of the cover body. A flip cover is covered on the second water outlet. The cover head of the flip cover covers the second water outlet. A flip cover shaft of the flip cover is fixed on the cover body and is opposite to the second water outlet. The middle of the flip cover is a hollow area. The hollow area is provided with a first water outlet. The first water outlet lies prone on the hollow area, and the surface of the first water outlet is flush with the surface of the flip cover. The bottom of the first water outlet is connected to a preset through hole on the cover body. The first water outlet is fixed on the cover body by a rotating shaft.

Optionally, a side of the first water outlet is provided with a flip portion, and the flip portion is extended from the hollow area when the first water outlet lies prone on the hollow area.

Optionally, the mouthpiece of the first water outlet is covered with a first water outlet stopper.

Optionally, a flip cover locking mechanism is provided at the edge of the cover body adjacent to the second water outlet, the cover head is buckled on the flip cover locking mechanism, and the flip cover locking mechanism is configured to fix and open the cover head.

Optionally, a first water outlet waterproof ring is arranged between the bottom of the first water outlet and the preset through hole.

Optionally, a water sealing pad is provided on the inner side of the cover head of the flip cover, and a cover waterproof ring is provided on the inner side of the cover body.

Optionally, a handle is provided on the cover body along a direction in which the flip cover is opened.

Optionally, the mouthpiece of the first water outlet faces away from the second water outlet.

A double-spout water bottle includes a bottle body and the double-spout bottle cover as described above, and the double-spout bottle cover is covered on the bottle body.

According to the present disclosure, a second water outlet is provided at the upper end of the cover body of the double-spout bottle cover, and a flip cover is covered on the second water outlet. When the flip cover is closed, the cover head of the flip cover covers the second water outlet to prevent water from flowing out. When the flip cover is opened, the second water outlet can be used for drinking water. The second water outlet protrudes from the cover body so that users can easily drink water from the second water outlet. The other end of the flip cover is fixed on the cover body by a flip cover shaft, and the flip cover shaft is rotated to open and close the flip cover. The middle of the flip cover is a hollow area, and a first water outlet lies prone on the hollow area. The surface of the first water outlet is flush with the surface of the flip cover. The bottom of the first water outlet is connected to a preset through hole on the cover body, and the first water outlet is fixed on the cover body by a rotating shaft, namely, the preset through hole functions as a second water outlet hole. When the first water outlet lies prone, the preset through hole is closed. When the first water outlet is erected, the preset through hole is opened to allow water to flow out through the preset through hole and the first water outlet. The double-spout bottle cover offers two water intake modes to flexibly control the water outflowing from the water bottle, which is convenient to use and solves the problem of the unchangeable water outflow of conventional water bottles.

The double-spout water bottle provided by the present disclosure works based on the water intake mode of the double-spout bottle cover, and the double-spout bottle cover can be used in combination with different water bottles to provide a multifunctional water bottle and satisfy various actual requirements.

Figure 1:
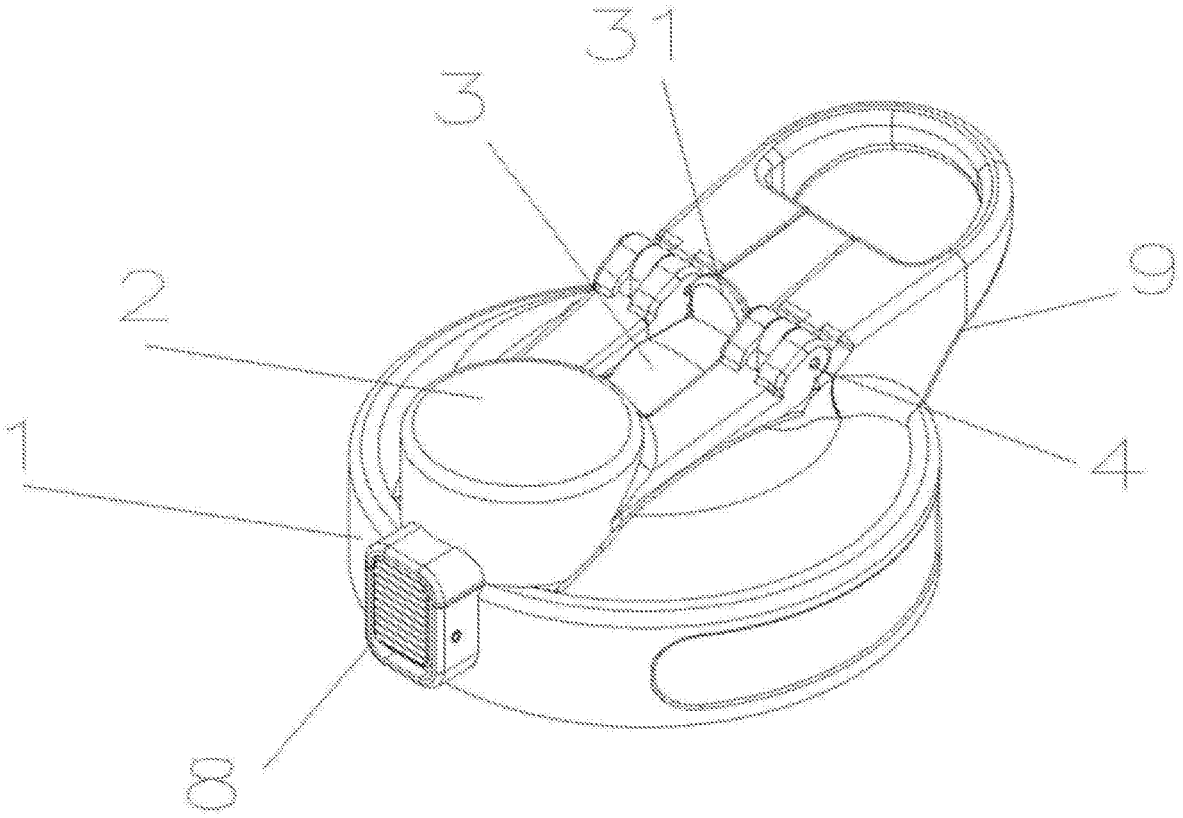
FIG. 1 is a perspective view showing the double-spout bottle cover according to an embodiment of the present disclosure.

The definitions of the reference numerals in the drawings are as follows:

1, cover body; 11, cover waterproof ring; 2, flip cover; 21, water sealing pad; 3, first water outlet; 31, flip portion; 32, mouthpiece of the first water outlet; 33, first water outlet waterproof ring; 34, first water outlet stopper; 35, rotating shaft; 4, flip cover shaft; 41; flip cover torsion spring; 5, second water outlet; 6, preset through hole; 7, hollow area; 8, button lock catch; 81, button; 82, button spring; 83, button shaft; 9, handle.

DETAILED DESCRIPTION OF THE EMBODIMENTS

In order to clearly describe the technical problems, technical solutions, and advantages of the present disclosure, hereinafter, the present disclosure is further described in detail with reference to the drawings and embodiments. It should be understood that the specific embodiments described herein are only intended to illustrate the present disclosure rather than limiting the present disclosure.

Figure 2:
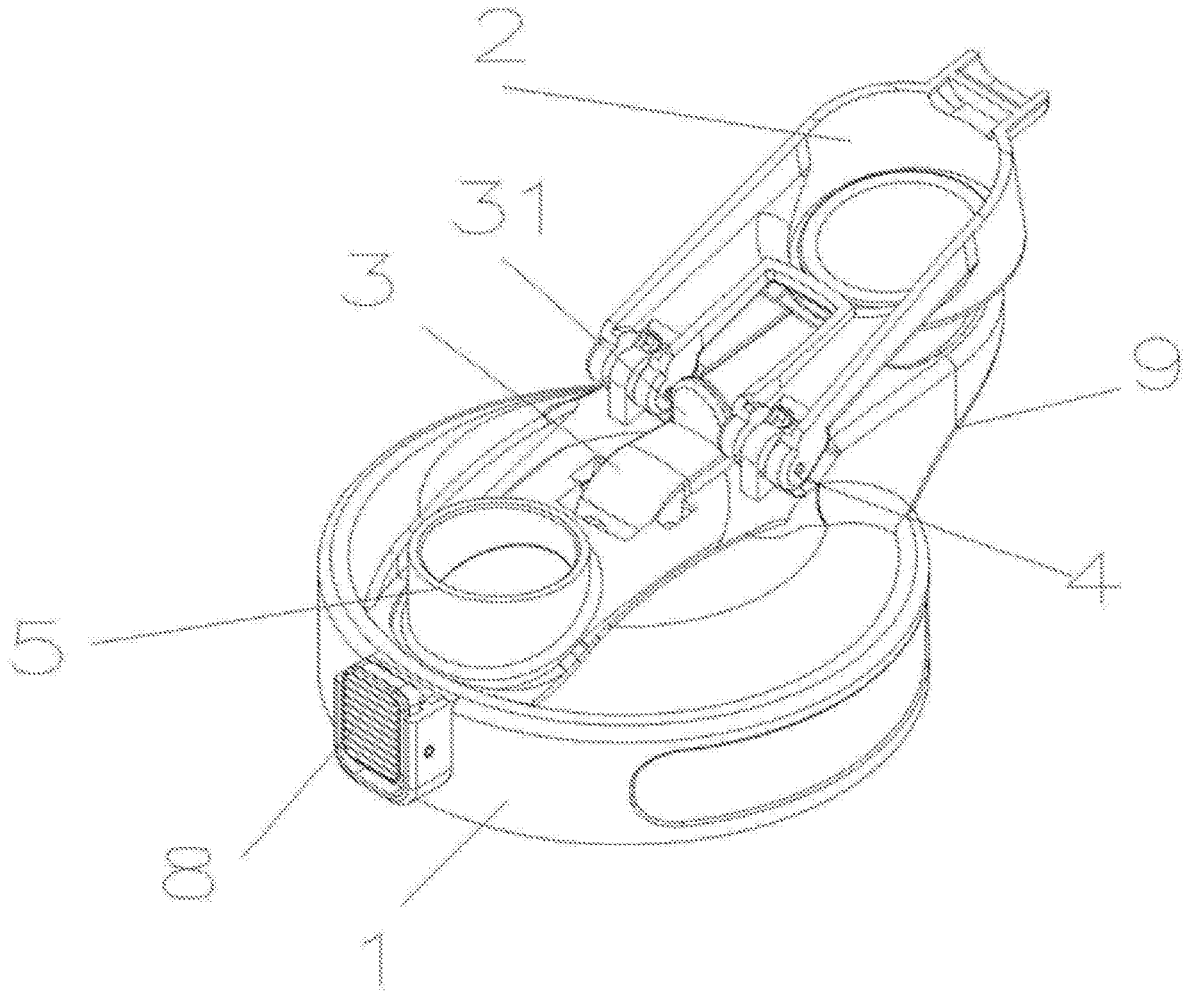
FIG. 2 is a perspective view showing the double-spout bottle cover when the flip cover is opened according to an embodiment of the present disclosure.

FIGS. 1-8 show the double-spout bottle cover. The cover body (1) is circular. The cover body is provided with two outlets, including the second water outlet (5) and the preset through hole (6). The second water outlet protrudes from the surface of the cover body, and is covered by the flip cover (2) or a cover analogous to the flip cover (2). The head of the flip cover covers the second water outlet to avoid water leakage. The middle of the flip cover is the hollow area (7). The flip cover shaft (4) of the flip cover is fixed on the cover body, and the flip cover can be opened and closed by the flip cover shaft. The cover body is provided with the handle (9) along the direction in which the flip cover is opened. A hollow ring is formed in the handle for easily griping or attaching a bottle string. FIG. 1 shows the closed flip cover. FIG. 2 shows the opened flip cover, and water in the bottle can be directly consumed through the second water outlet.

Figure 3:
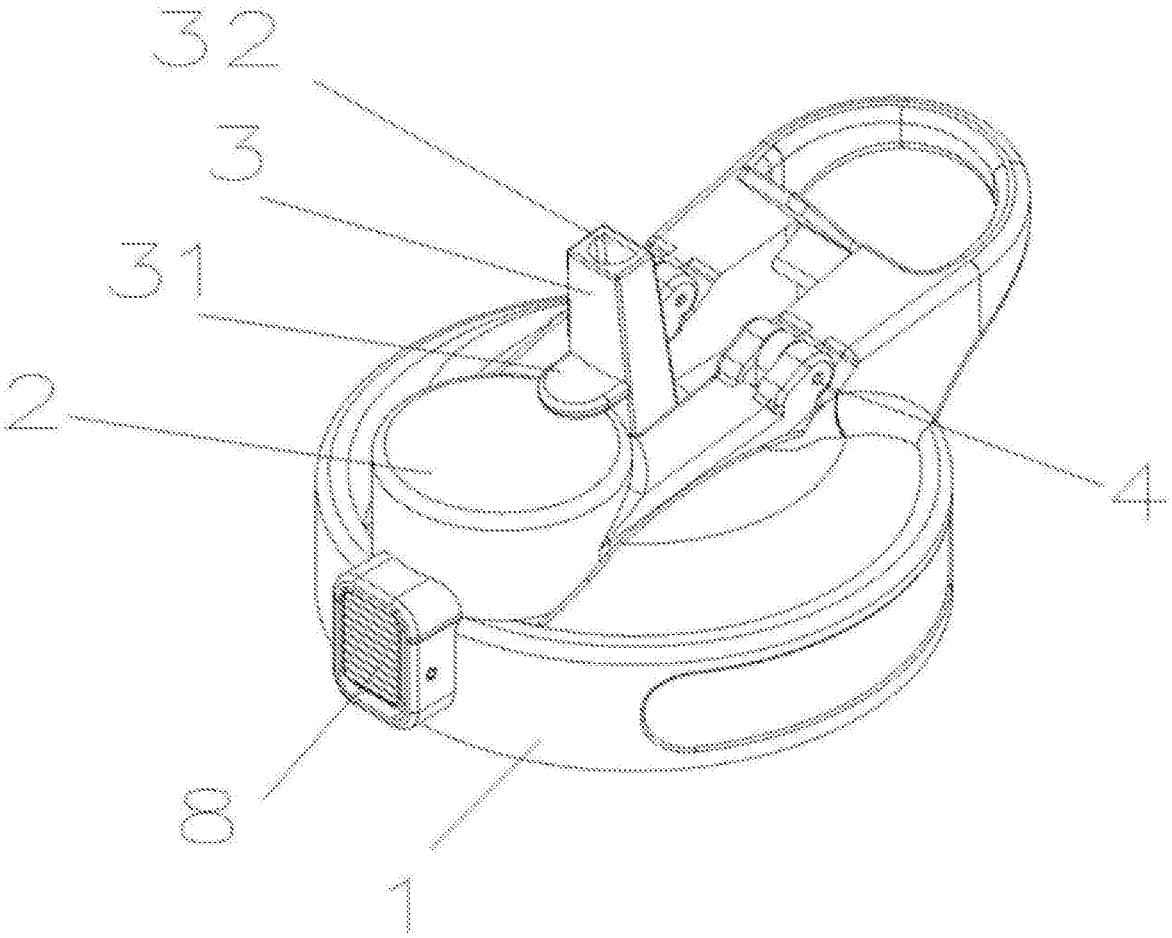
FIG. 3 is a perspective view showing the double-spout bottle cover when the first water outlet is opened according to an embodiment of the present disclosure.
Figure 4:
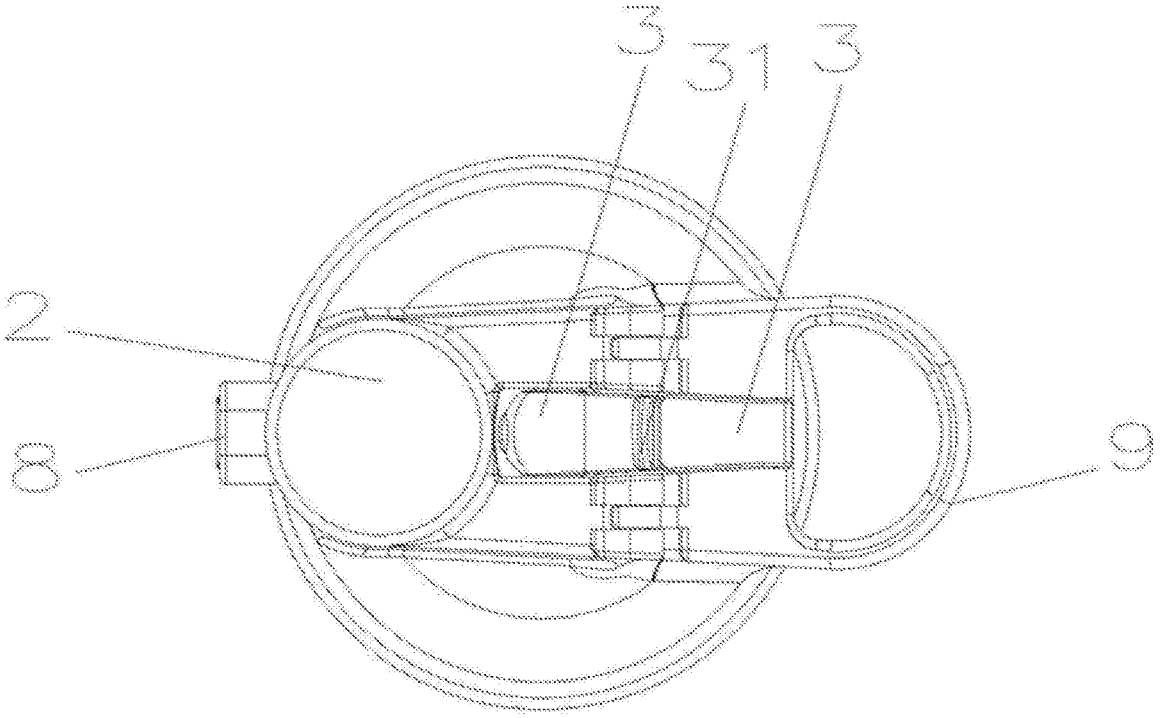
FIG. 4 is a top view of the double-spout bottle cover according to an embodiment of the present disclosure.
Figure 5:
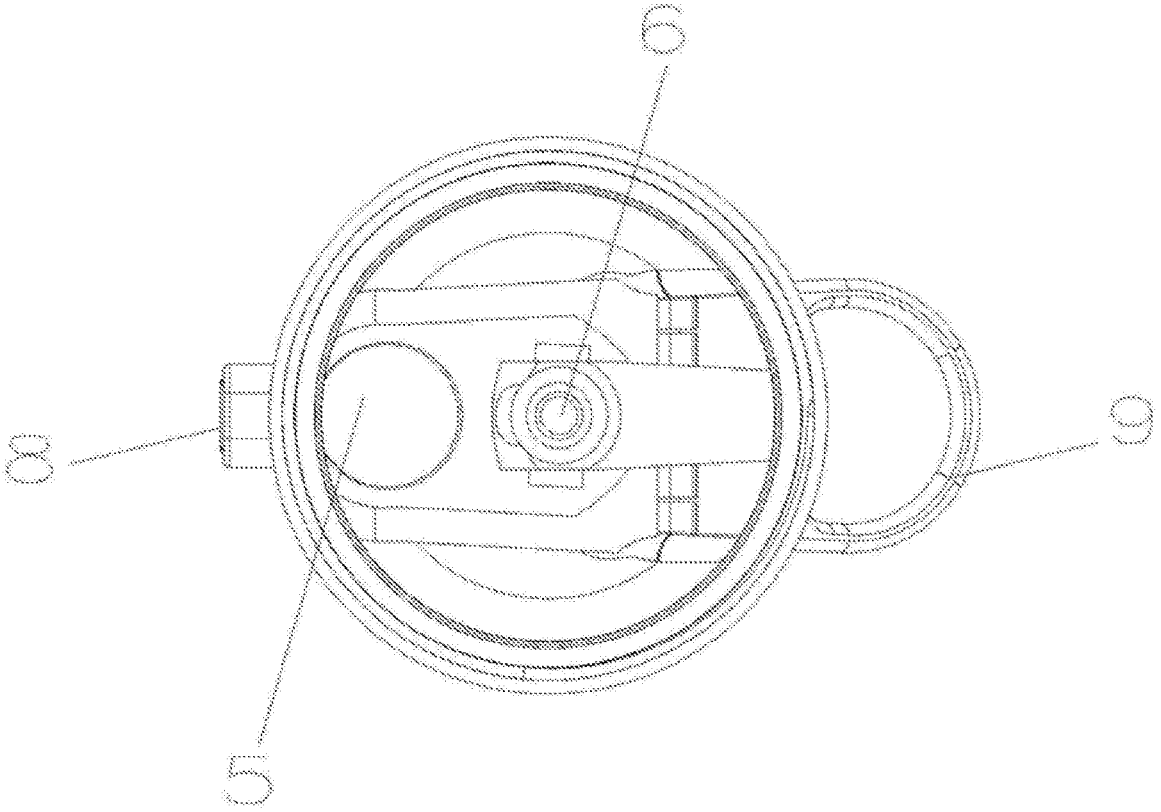
FIG. 5 is a bottom view of the double-spout bottle cover according to an embodiment of the present disclosure.
Figure 6:
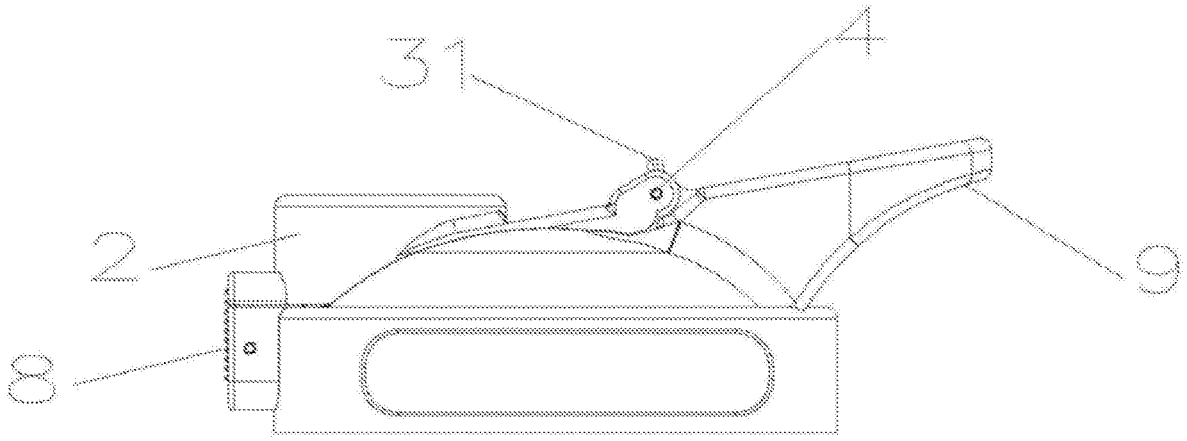
FIG. 6 is a front view of the double-spout bottle cover according to an embodiment of the present disclosure.
Figure 7:
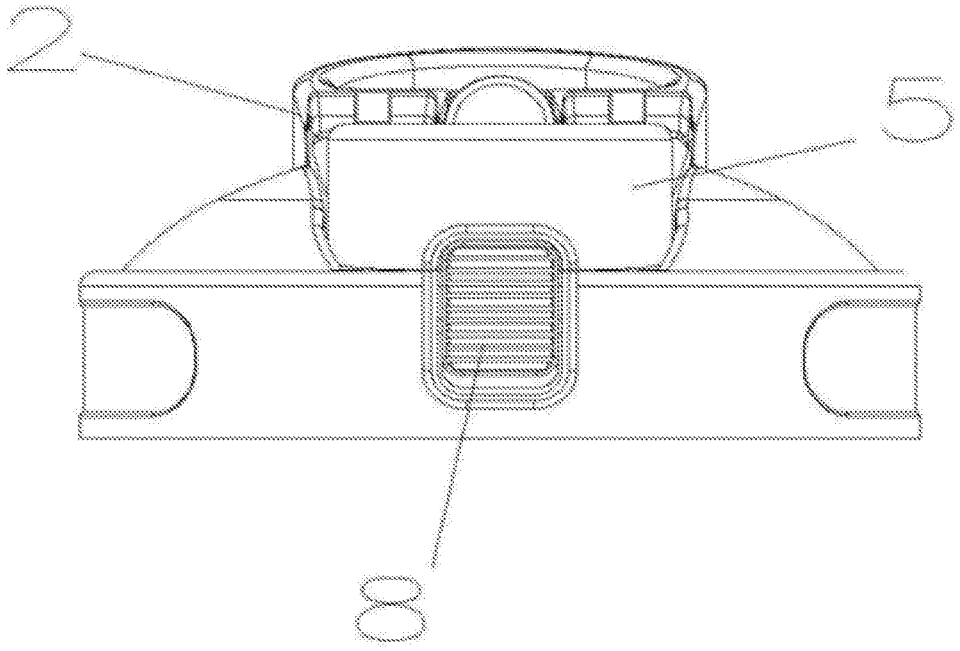
FIG. 7 is a right view of the double-spout bottle cover according to an embodiment of the present disclosure.

The first water outlet (3) lies prone on the hollow area of the cover body. The bottom of the first water outlet is connected to the preset through hole (6). The first water outlet is provided with the flip portion (31). When the first water outlet is in a prone position (as shown in FIGS. 1-2), the preset through hole is closed, and the water cannot flow out of the bottle. The flip portion is extended from the hollow area to allow users to flip the first water outlet. When the first water outlet is flipped to be erected (as shown in FIG. 3), the preset through hole and the first water outlet communicate, allowing water to flow out from the mouthpiece (32) of the first water outlet for drinking. When the flip cover is in the closed position, and the water outflow from the first water outlet is less than the water outflow from the second water outlet, that is, another water intake mode is provided for users.

Further, in an embodiment, the mouthpiece of the first water outlet is further provided with the first water outlet stopper (34) to prevent dust from entering the first water outlet.

Figure 8:
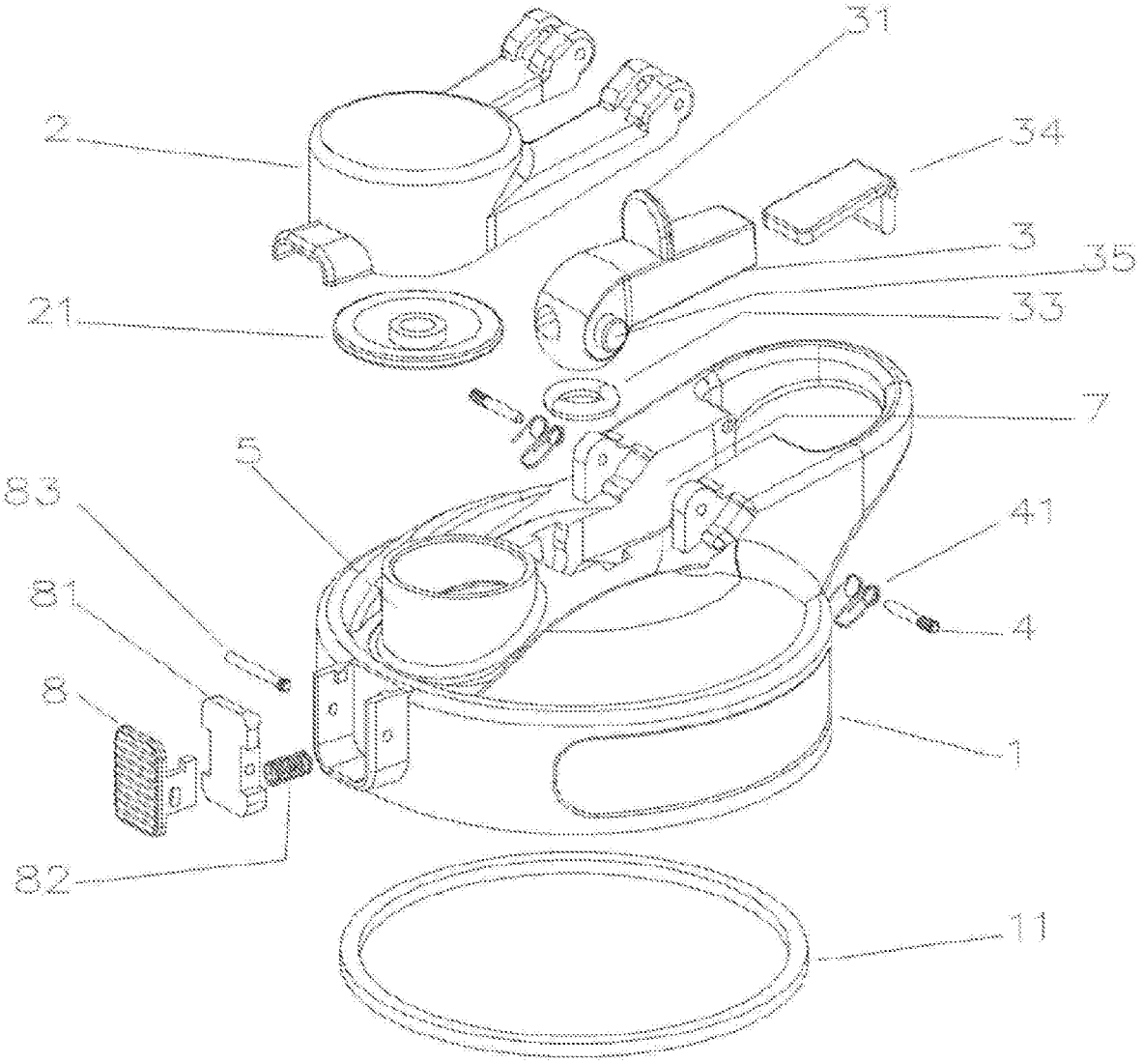
FIG. 8 is an exploded view showing the structures of the double-spout bottle cover according to an embodiment of the present disclosure.

Further, in an embodiment, the flip cover locking mechanism is provided at the edge of the cover body adjacent to the second water outlet. The cover head is buckled on the flip cover locking mechanism, and the flip cover locking mechanism is configured to fix and open the cover head. In other words, the flip cover locking mechanism functions as a latch so that the flip cover can be automatically opened for accessing water by the latch. Specifically, as shown in FIG. 8, the flip cover locking mechanism includes the button lock catch (8), the button (81), the button shaft (83), and the button spring (82). The flip cover shaft is connected to the cover body by the flip cover torsion spring (41). When a user presses the button lock catch, the flip cover is sprung upward by the elastic force of the flip cover torsion spring to reveal the second water outlet.

Further, in an embodiment, as shown in FIG. 8, the first water outlet waterproof ring (33) is arranged between the bottom of the first water outlet and the preset through hole to enhance the waterproofness. The water sealing pad (21) is provided on the inner side of the cover head of the flip cover, and the cover waterproof ring (11) is provided on the inner side of the cover body, which prevents water from leakage.

Further, in an embodiment, the mouthpiece of the first water outlet faces opposite to the second water outlet to facilitate mold forming and production. A straw may also be connected to the bottom of the first water outlet, namely, the straw passes through the preset through hole (6) and extends from the mouthpiece (32) of the first water outlet.

Understandably, the double-spout bottle cover provides two water intake modes that are optional for users according to actual needs during use. Moreover, the double-spout bottle cover can be used in combination with different water bottles such as sports water bottles and kids' water bottles to satisfy various actual requirements.

The foregoing description of the double-spout bottle cover of the present disclosure is intended to facilitate understanding of the present disclosure, but the embodiments set out in the present disclosure are not limited by the above-mentioned embodiments. Any changes, modifications, substitutions, combinations, and simplifications made without departing from the principle of the present disclosure are construed as equivalent replacements and would fall within the scope of protection of the present disclosure.

What is claimed is:

1. A double-spout bottle cover comprising:

a cover body, a first water outlet arranged on a first portion of a first surface of the cover body adjacent to a first edge of the cover body in a hollow area of the cover body;

a first water outlet shaft connecting the first water outlet to the cover body, wherein the first water outlet is configured to rotate around the first water outlet shaft between a prone position relative to the first surface of the cover body and an upright position relative to the first surface of the cover body;

a second water outlet arranged on a second portion of the first surface of the cover body adjacent to a second edge of the cover body, wherein the first portion and the second portion are adjacent to each other, and wherein the first edge and the second edge are opposing edges;

a flip cover comprising two arms, each of the two arms comprising two prongs, the flip cover comprising a cover head for covering and uncovering the second water outlet;

two flip cover shafts connecting each of the two prongs of the two arms of the flip cover to projections of the cover body, and each of the two flip cover shafts being connected to the cover body by a flip cover torsion spring, wherein the two flip cover shafts are located on either side of the hollow area and positioned adjacent to the first edge of the cover body, and wherein the flip cover is configured to rotate around the two flip cover shafts between a first position to uncover the second water outlet and a second position to cover the second water outlet with the cover head; and a preset hole positioned in the hollow area and connected with the first water outlet, wherein the preset hole is disposed between the two flip cover shafts and the second water outlet.

2. The double-spout bottle cover according to claim 1, wherein, a side of the first water outlet is provided with a flip portion, and the flip portion is extended from the hollow area when the first water outlet lies prone on the hollow area.

3. The double-spout bottle cover according to claim 1, wherein, a mouthpiece of the first water outlet is covered with a first water outlet stopper.

4. The double-spout bottle cover according to claim 1, wherein a flip cover locking mechanism is provided at a third edge of the cover body, the third edge of the cover body is adjacent to the second water outlet on a second surface of the cover body, the cover head is buckled on the flip cover locking mechanism, and the flip cover locking mechanism is configured to fix and open the cover head.

5. The double-spout bottle cover according to claim 4, wherein, the flip cover locking mechanism comprises a button lock catch, a button, a button shaft, and a button spring.

6. The double-spout bottle cover according to claim 1, wherein a first water outlet waterproof ring is arranged between the first water outlet and the preset through hole.

7. The double-spout bottle cover according to claim 1, wherein, a water sealing pad is provided on an inner side of the cover head of the flip cover, and a cover waterproof ring is provided on an inner side of the cover body.

8. The double-spout bottle cover according to claim 1, further comprising a handle positioned adjacent to the two flip cover shafts.

9. The double-spout bottle cover according to claim 1, wherein, a mouthpiece of the first water outlet faces opposite to the second water outlet.

10. A double-spout water bottle, comprising:

a bottle body, and the double-spout bottle cover according to claim 1;

wherein the double-spout bottle cover is covered on the bottle body.

11. The double-spout water bottle according to claim 10, wherein, a side of the first water outlet is provided with a flip portion, and the flip portion is extended from the hollow area when the first water outlet lies prone on the hollow area.

12. The double-spout water bottle according to claim 10, wherein, a mouthpiece of the first water outlet is covered with a first water outlet stopper.

13. The double-spout water bottle according to claim 10, wherein, a flip cover locking mechanism is provided at an edge of the cover body, the edge of the cover body is adjacent to the second water outlet, the cover head is buckled on the flip cover locking mechanism, and the flip cover locking mechanism is configured to fix and open the cover head.

14. The double-spout water bottle according to claim 13, wherein, the flip cover locking mechanism comprises a button lock catch, a button, a button shaft, and a button spring.

15. The double-spout water bottle according to claim 10, wherein, a first water outlet waterproof ring is arranged between the first water outlet and the preset through hole.

16. The double-spout water bottle according to claim 10, wherein, a water sealing pad is provided on an inner side of the cover head of the flip cover, and a cover waterproof ring is provided on an inner side of the cover body.

17. The double-spout water bottle according to claim 10, further comprising a handle positioned adjacent to the two flip cover shafts.

18. The double-spout water bottle according to claim 10, wherein, a mouthpiece of the first water outlet faces opposite to the second water outlet.

19. The double-spout bottle cover of claim 1, wherein the first water outlet has a first diameter and the second water outlet has a second diameter, the first diameter being less than the second diameter.

20. The double-spout bottle cover of claim 5, wherein the button lock catch, the button, and the button spring are arranged in a row and the button is disposed between the button lock catch and the button spring, and wherein the flip cover locking mechanism is configured to receive and release the cover head.

* * * * *